United States Patent [19]

Brown et al.

[11] Patent Number: 4,845,810

[45] Date of Patent: Jul. 11, 1989

[54] SELF CLOSING HINGE

[76] Inventors: Ron Brown; Florentino Cabais, both of 20509 Earlgate St., Walnut, Calif. 91789

[21] Appl. No.: 205,672

[22] Filed: Jun. 13, 1988

[51] Int. Cl.[4] ..... F05D 1/12

[52] U.S. Cl. ..... 16/284; 16/278; 16/296; 16/291; 16/303; 16/50

[58] Field of Search ..... 16/286, 293, 296, 291, 16/303, 307, 278, 284, 50

[56] References Cited

U.S. PATENT DOCUMENTS

| | | | |
|---|---|---|---|
| 823,911 | 6/1906 | Anderson | 16/296 |
| 2,702,651 | 2/1955 | Graham | 16/293 |
| 3,262,149 | 7/1966 | Gorton et al. | 16/296 |
| 3,391,420 | 7/1968 | Anderson | 16/291 |
| 3,605,175 | 9/1971 | Wilson | 16/293 |
| 3,613,151 | 10/1971 | Anderson et al. | 16/278 |
| 3,628,215 | 12/1971 | Everburg | 16/225 |
| 3,710,417 | 1/1973 | Berman et al. | 16/296 |
| 3,715,778 | 2/1973 | Wilson | 16/278 |
| 3,822,440 | 7/1974 | Stansbury, Jr. et al. | 16/303 |
| 3,837,043 | 9/1974 | Coe | 16/303 |
| 3,842,463 | 10/1974 | Wehner | 16/296 |
| 3,908,228 | 9/1975 | Newcomer | 16/286 |
| 3,950,818 | 4/1976 | Holmes | 16/296 |
| 3,972,090 | 8/1976 | Holmes | 16/50 |
| 4,190,925 | 3/1980 | Koivusalo | 16/54 |
| 4,247,965 | 2/1981 | Lautenschlager | 16/296 |
| 4,354,611 | 10/1982 | Propst et al. | 16/74 |
| 4,477,941 | 10/1984 | Gregg | 16/296 |
| 4,494,273 | 1/1985 | Straus | 16/278 |
| 4,549,832 | 10/1985 | Sterl | 16/277 |

FOREIGN PATENT DOCUMENTS 1945738 3/1971 Fed. Rep. of Germany .

OTHER PUBLICATIONS

Amerock Catalog Sheet.

*Primary Examiner*—Kenneth J. Ramsey
*Assistant Examiner*—Edward A. Brown
*Attorney, Agent, or Firm*—Harris, Kern, Wallen & Tinsley

[57] ABSTRACT

A self closing hinge having a single unitary spring element which functions to maintain the hinge in the open position and to move the hinge to the fully closed position after the hinge is partially closed. A unitary hinge spring having a base section and a ramp section joined by a resilient section which is typically a C shape in cross section.

6 Claims, 2 Drawing Sheets

SELF CLOSING HINGE

BACKGROUND OF THE INVENTION

This invention relates to self closing hinges and in particular, to a new and improved spring for a self closing hinge, which spring is a unitary item, typically molded of a resilient plastic, which may be directly substituted for other spring designs now being used.

Several types of self closing hinges are presently on the market. In one design, a small injection molded part is placed between the hinge knuckle and the door wing of the hinge. Two compression springs are positioned within the small plastic part. One surface of this part is contoured to effect a ramp or bevel or step. This ramp surface bears against the hinge knuckle, and the opposing surface is held in position by a portion of the door wing. The hinge knuckle has a void in its circumference that matches the dimensions of the plastic insert.

In operation of such a hinge, when the hinge wing is pulled outward to open, the leading edge of the knuckle adjoining the void engages the ramp and compresses the two springs within the plastic part. Since there is now an interference with the knuckle surface and the ramp, the door stays open and typically at a position of 30–35 degrees from a closed position. There is no further increased interference on the contact point between the knuckle and the ramp so the door can open for full access. Upon closing, the ramp of the plastic part disengages from the knuckle at the point where the void begins. This in turn causes the door to self close.

Another self closing design utilizes a spring incorporated around the hinge pin, with the ends of the spring extended and in contact with the hinge wings or its housing. When the hinge is activated, these extended ends produce tension within the spring thereby providing the self closing or return feature.

SUMMARY OF THE INVENTION

It is an object of the present invention to provide a new and improved self closing hinge having a unitary hinge spring which is a single component that can be directly substituted for the multiple spring combination devices presently being used. A further object is to provide such a hinge spring which can be a single plastic molding, thereby eliminating any need for metal wire springs of any type or for the assembly of springs to other parts. Other objects, advantages, features and results will more fully appear in the course of the following description.

In the preferred embodiment, the self closing hinge has two hinge elements joined by a hinge pin, with one hinge element having a hinge knuckle partially wrapped around the pin and with the other hinge element having a hinge spring pocket, with a unitary hinge spring positioned in the spring pocket and having a ramp section of the spring engaging the hinge knuckle and a base section of the spring in the spring pocket, with the ramp and base sections joined by a resilient section, typically a C shape in cross section.

DESCRIPTION OF THE PREFERRED EMBODIMENTS

Figure 1:
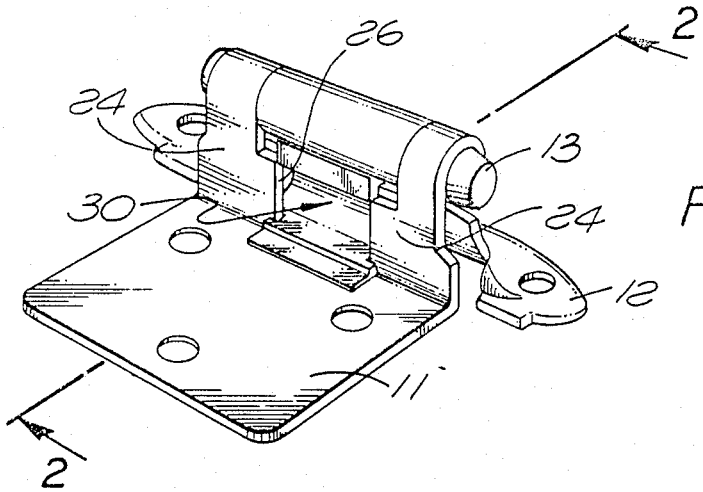
FIG. 1 is a perspective view of a self closing hinge incorporating the presently preferred embodiment of the invention.
Figure 2:
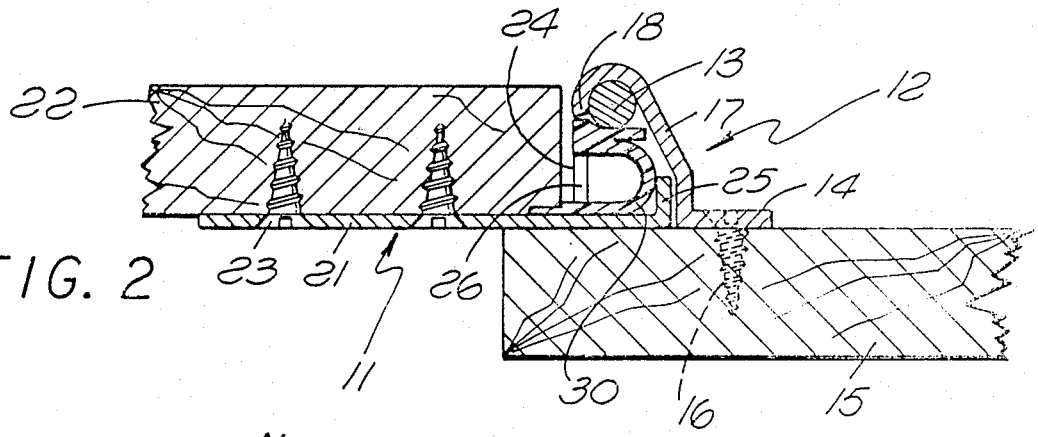
FIG. 2 is an enlarged partial sectional view taken along the line 2—2 of FIG. 1, showing the hinge in the closed position.
Figure 3:
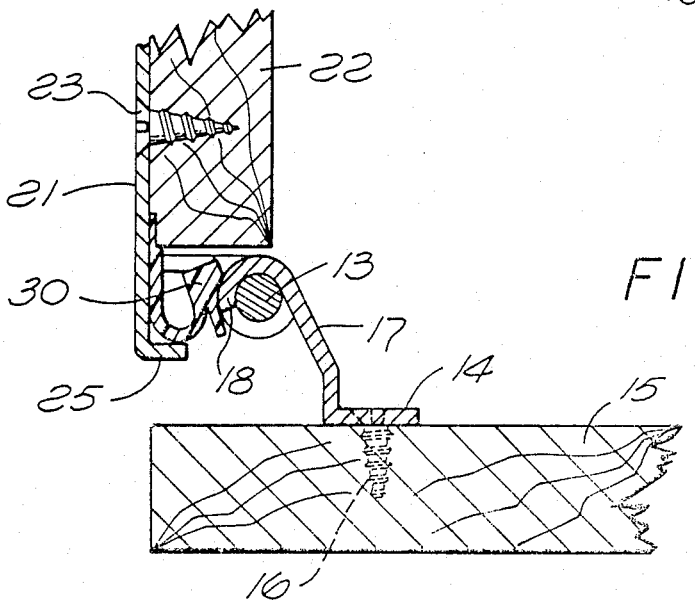
FIG. 3 is a view similar to that of FIG. 2 showing the hinge in the open position.

The hinge shown in the drawing figures has a door wing or element 11 and a frame wing or element 12 joined by a pin 13. The frame wing 12 has a base 14 which may be attached to a frame 15 by screws 16. The frame wing 12 also has an upright member 17 which terminates in a knuckle 18 wrapped part way around the pin 13, with a void or a gap between the free end of the knuckle 18 and the upright member 17, as seen in FIGS. 2 and 3.

The door wing 11 has a base 21 which may be attached to a door 22 by screws 23. The door wing 11 also has spaced upright members 24 which are wrapped around the pin 13, and another upright member 25 spaced from the upright members 24. Both the door wing 11 and the frame wing 12 may be formed from sheet metal stock, with the upright member 25 of the door wing formed from the material in the notch or slot 26 between the upright members 24.

The construction thus far described may be conventional, and the hinge spring of the invention may be utilized with various forms of hinges including inset, overlay, reverse bevel, flush and butt.

Figure 4:
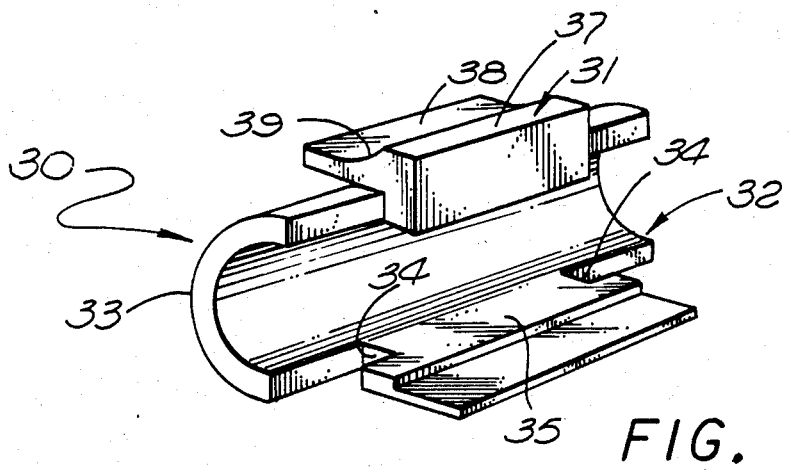
FIG. 4 is an enlarged perspective view of the hinge spring of FIG. 1.

A hinge spring 30 is positioned in the hinge pocket between the upright members 24, 25, and is shown in detail in FIG. 4. The hinge spring 30 is formed as a single piece, and preferably is molded of a plastic material having some resiliency, such as an acetal resin. The preferred embodiment of the hinge spring has a ramp section 31 joined to a base section 32 by an intermediate section 33 having a C shape cross section. The base section 32 has notches 34 at each edge to define a tongue 35 which may project into the notch 26 between the upright members 24 of the door wing 11 for positioning the spring in the spring pocket. The ramp section 31 has an upper level 37 and a lower level 38 joined by a bevel or step 39, which preferably is sloped, and which is referred to as a ramp.

When in the closed position of FIG. 2, the hinge knuckle 18 is in engagement with the ramp section 31 of the hinge, but the parts are dimensioned so that there is little if any compression force exerted on the spring. As the door wing 11 moves upward toward the open position of FIG. 3, the hinge knuckle further engages the ramp section of the hinge and compresses the C shape as seen in FIG. 3. The compressed spring provides a force holding the spring and knuckle in engagement and holding the door in the open position.

The spring, force can be changed by varying the wall thickness of the C shaped section at different points in its arc and by changing the thickness of the knuckle, and the angle of the ramp of the ramp section can be varied to increase or decrease the force required to open the hinge.

When the door is being moved toward the closed position from the open position, the hinge knuckle remains in contact with the ramp section as the hinge knuckle rotates relative to the ramp section. This contact is maintained until the free end of the knuckle arrives at the ramp 39. At this point because of the inertia of the closing door and the reduction in pressure occasioned by the end knuckle leaving the ramp, the spring action moves the door to the closed position.

The unitary hinge spring provides the desirable operating characteristics of the prior art designs, while eliminating the need for a plurality of parts and the need for metal wire springs. The hinge spring provides a force for maintaining the door in the open position while at the same time providing a force which moves the door to the fully closed position, once the door is manually moved to a partly closed position.

Figure 5:
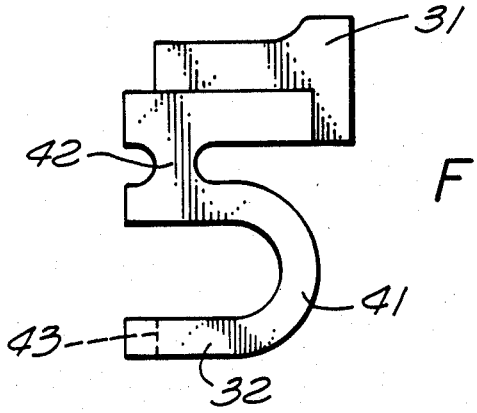
FIGS. 5 and 6 are end views of hinge springs showing alternative embodiments of the invention.
Figure 6:
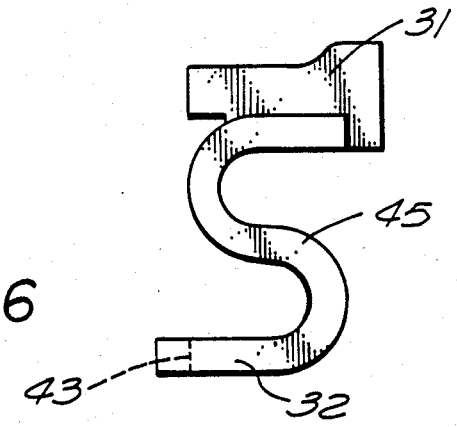

Some alternative configurations for the hinge spring are shown in FIGS. 5 and 6. In the spring of FIG. 5, the ramp section 31 is joined to the base section 32 by an intermediate section having a C shape 41 adjoining the base section 32, and a longitudinal rib 42 connecting the C shape 41 and the ramp section 31. In this design, a notch 43 is provided in the end of the base section 32 for positioning around the upright member 25 of the door wing base 21.

In the embodiment of FIG. 6, the base section 32 is joined to the ramp section 31 by a spring section 45 which is S shaped in cross section. The design of FIG. 5 normally will be the stiffest of the three embodiments illustrated, and the design of FIG. 6 will be medium stiff.

We claim:

1. In a self closing hinge having first and second hinge elements joined by a hinge pin for rotating of said second element relative to said first element about a hinge axis defined by said pin, with said first hinge element having a hinge knuckle only partially wrapped around said hinge pin and with said second hinge element having means defining a hinge spring pocket, with said hinge elements moveable relative to each other between a closed position and an open position, the improvement comprising:

a unitary hinge spring having a base section and a ramp section with said resilient section integral with said base and ramp sections and having an open channel between said base and ramp sections joined by a resilient section, with said ramp section changing elevation along a path perpendicular to said hinge axis, and including means for positioning said spring in said pocket with said base section engaging said second hinge element and said ramp section engaging said first hinge element knuckle.

2. A self closing hinge as defined in claim 1 wherein said hinge spring resilient section is integral with said base and ramp sections and has a C shape in cross section.

3. A self closing hinge as defined in claim 1 wherein said hinge spring resilient section is integral with said base and ramp sections and has a S shape in cross section.

4. A self closing hinge as defined in claim 1 wherein said hinge spring resilient section is integral with said base and ramp sections and includes a C shape in cross section with a rib joining said ramp section and C shape.

5. A self closing hinge as defined in any of claims 1–4 wherein said ramp section has an upper level and a lower level joined at a ramp, with said knuckle engaging said ramp and compressing said spring away from said pin when said hinge is in said open position, and with said knuckle clear of said ramp with said spring engaging said pin when said hinge is in said closed position.

6. A self closing hinge as defined in any of claims 1–4 wherein said second hinge element includes a first upright member for engaging said pin and a second upright member spaced from said first upright member defining said spring pocket therebetween, and wherein said spring base section includes notch means for engaging one of said upright members in spring positioning relation.

* * * * *